US006898872B2

(12) United States Patent
McKissic

(10) Patent No.: US 6,898,872 B2
(45) Date of Patent: May 31, 2005

(54) OUTER SOLE AND METHOD FOR FORMING A SHOE SUPPORTING A GRIPPING DEVICE

(76) Inventor: James McKissic, 200 Riverfront Dr., Apt. 7B, Detroit, MI (US) 46228

( * ) Notice: Subject to any disclaimer, the term of this patent is extended or adjusted under 35 U.S.C. 154(b) by 0 days.

(21) Appl. No.: 10/299,304

(22) Filed: Nov. 18, 2002

(65) Prior Publication Data

US 2003/0115778 A1 Jun. 26, 2003

Related U.S. Application Data

(63) Continuation-in-part of application No. 09/670,951, filed on Sep. 27, 2000, now abandoned.

(51) Int. Cl.[7] ..... A43B 3/24
(52) U.S. Cl. ..... 36/100; 36/15
(58) Field of Search ..... 36/100, 15, 71.5

(56) References Cited

U.S. PATENT DOCUMENTS 1,719,724 A * 7/1929 Pochin et al. ..... 12/33
1,804,545 A * 5/1931 Radburne ..... 36/31
2,330,989 A * 10/1943 Nevills ..... 425/119
3,083,476 A * 4/1963 Herschdorf ..... 36/15
3,693,269 A * 9/1972 Guarrera ..... 36/15
4,317,294 A * 3/1982 Goodyear ..... 36/100
4,387,516 A * 6/1983 Laux ..... 36/43
5,661,915 A * 9/1997 Smith ..... 36/15

FOREIGN PATENT DOCUMENTS

GB 2238707 * 6/1991

* cited by examiner

*Primary Examiner*—Ted Kavanaugh
(74) *Attorney, Agent, or Firm*—Loletta L. Darden

(57) ABSTRACT

A replacement outer sole and method for converting a non-spiked dress or sport shoe to a spiked shoe. The replacement outer sole includes an outer sole that supports a plurality of surface gripping devices in an outer periphery thereof. The replacement outer sole is coupled to the upper portion of a flat-soled shoe, converting the non-spiked shoe to a sports shoe having a surface gripping device such as cleats or spikes generally used for walking, running golfing or other activities.

6 Claims, 4 Drawing Sheets

OUTER SOLE AND METHOD FOR FORMING A SHOE SUPPORTING A GRIPPING DEVICE

CROSS REFERENCE

This application is a continuation-in-part of U.S. application Ser. No. 09/670,951, entitled "An Outer Sole and Method for Forming a Shoe Supporting a Gripping Device" and filed on Sep. 27, 2000 now abandoned.

FIELD OF THE INVENTION

The present invention relates to a replacement outer sole and method for converting a flat-soled dress or sport shoe to a shoe supporting a surface-gripping device. More particularly, the present invention relates to a replacement outer sole and heel plate for coupling to a shoe upper of a sport or dress shoe, wherein the replacement outer sole and heel plate support a plurality of gripping devices such as cleats or spikes.

BACKGROUND OF THE INVENTION

Attachments for adapting non-spiked shoes for use in activities where surface gripping or traction is desirable are known. U.S. Pat. No. 5,600,901 ("the '901 patent") describes such a device. The device of the '901 patent relates to an attachment or add-on which fits over a dress or sports shoe. Thus, there is the possibility of movement between the attachment and the shoe over which it is placed when the attachment is worn by the user. Consequently, there is needed an apparatus that permits coupling a gripping or traction device directly to the shoe upper or existing shoe outer sole. There is also a need for an apparatus that will permit a user particular about his appearance or budget to select and convert a shoe meeting his/her particular requirements.

SUMMARY OF THE INVENTION

The present invention is directed to a replacement outer sole for converting a dress or sport shoe to a spiked shoe. The replacement outer sole includes an outer sole that defines one or more openings therein for receiving a surface-gripping device. The gripping device can include spikes or cleats of the type generally used for walking, running, golfing or other activities. The replacement outer sole can also include an integral heel portion that also supports one or more gripping devices such as spikes or cleats.

The surface gripping devices can be coupled to the replacement outer sole and/or the heel plate using threaded inserts. The openings formed in the bottom surface of the replacement outer sole and the heel plate, respectively, can be designed to receive a threaded insert. The insert can be placed in each opening, and a gripping devices having one end supporting threads adapted to mate with those of the threaded insert can then be received in each opening.

In an alternative embodiment, the surface gripping devices can be coupled to, or integrally formed as part of, the outer sole and the heel plate, respectively, during the process of molding the replacement outer sole and the heel plate. This embodiment not only creates a unitary structure, it also eliminates the need for inserts or other devices for holding the gripping device in position in the outer sole and/or the heel plate.

The replacement outer sole and heel plate can be coupled to a shoe selected by the wearer in accordance with the user's particular fashion or other needs. For instance, a user could convert his/her favorite shoes to golf shoes. This could be accomplished by coupling the replacement sole to the shoe in the manner described.

The present invention is also directed to a method for converting a non-spiked dress or sport shoe to a spiked shoe, the method including the steps of (1) providing a shoe having a shoe upper and a first outer sole; (2) providing a second outer sole supporting surface gripping devices therein; (3) permanently affixing the second outer sole to the bottom surface of the shoe upper; (4) providing a heel plate supporting surface gripping devices therein; and (5) permanently affixing the heel plate to the bottom surface of the shoe upper.

The invention is also directed to a kit including materials for converting a dress shoe into a shoe having an outer sole supporting a surface gripping device. More specifically, the kit includes materials for converting a dress or sport shoe to a golf shoe. The kit includes an outer sole supporting a plurality of surface gripping devices such as spikes or cleats and a waterproof adhesive for securing the outer sole to the outer sole or shoe upper of the shoe. The outer sole may be sized to fit a variety of shoe sizes. Thus, the replacement outer sole includes trim guidelines, wherein the replacement outer sole can be cut-down, as necessary, to a size appropriate for the shoe to be converted. The kit may also include a cleaner for preparing, e.g., cleaning, the shoe outer sole or shoe upper prior to affixing the new outer sole thereto.

The present invention is also directed to a method for using the elements of the kit to convert a dress or sport shoe to an athletic shoe supporting a surface gripping device. The method includes the steps of (1) providing a kit including a replacement outer sole supporting a plurality of surface gripping devices and an adhesive for coupling the replacement outer sole to an outer sole of a shoe to be converted or to the shoe upper of a shoe to be converted; (2) adjusting, as necessary, the size of the replacement outer sole to fit the shoe to be converted; and (3) permanently affixing the replacement outer sole to the shoe to be converted. The method may also include the steps of cleaning the shoe upper or the existing shoe outer sole or the replacement outer sole to prepare the mating surfaces for receiving the replacement outer sole and smoothing any rough or raised areas on the mating surface using sand paper or other similar abrasive material.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 1:
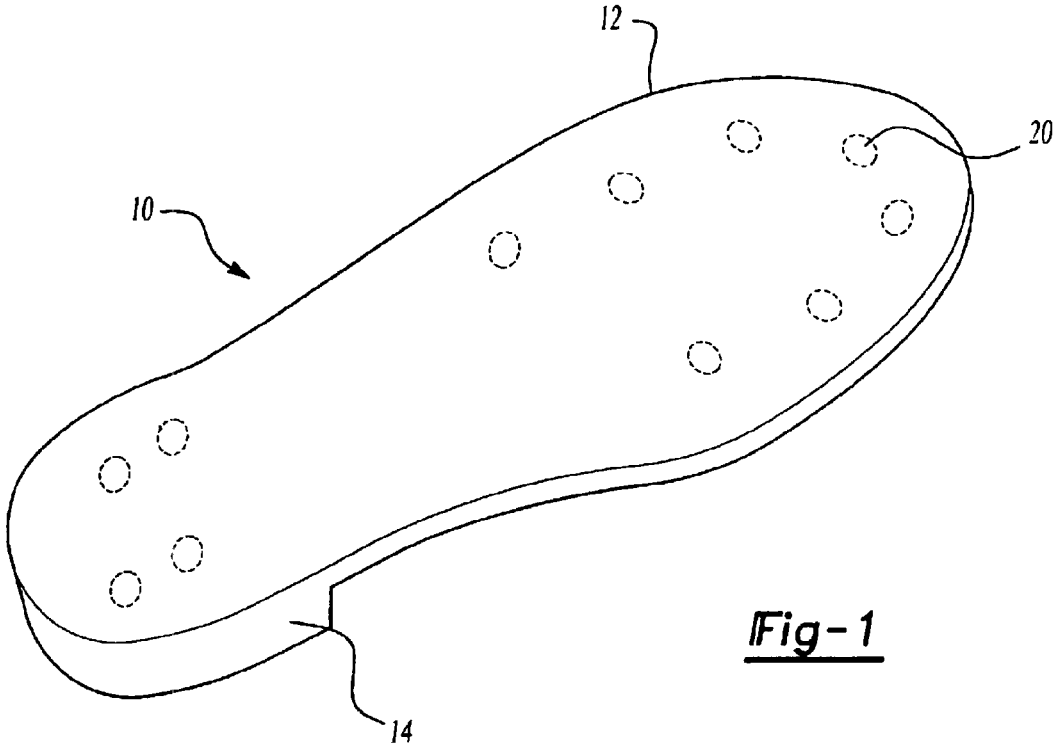
FIG. 1 shows an integral outer sole and heel plate formed in accordance with the teachings of the present invention.
Figure 3:
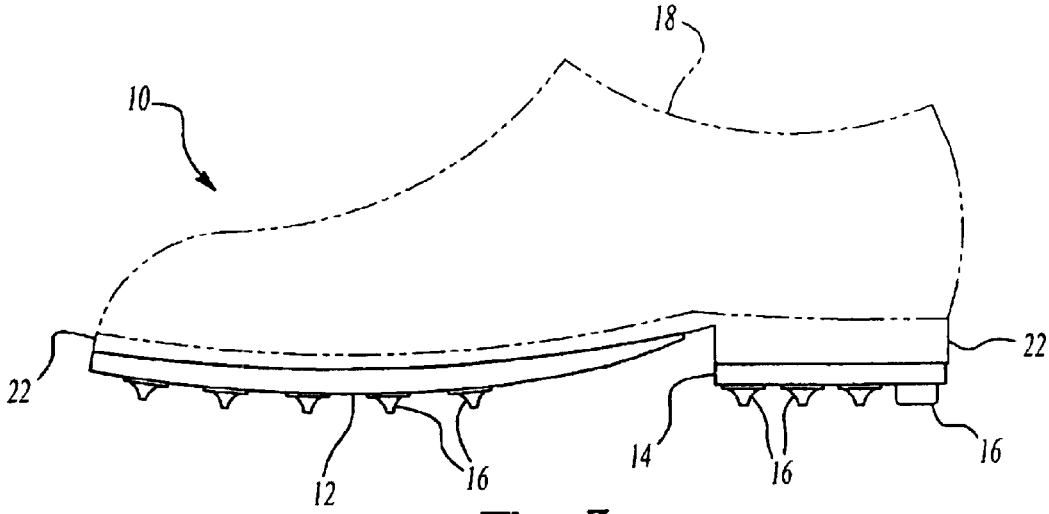
FIG. 3 shows an elevation view of the outer sole and heel plate of FIG. 2 coupled to the upper portion of a typical flat-soled shoe.
Figure 2:
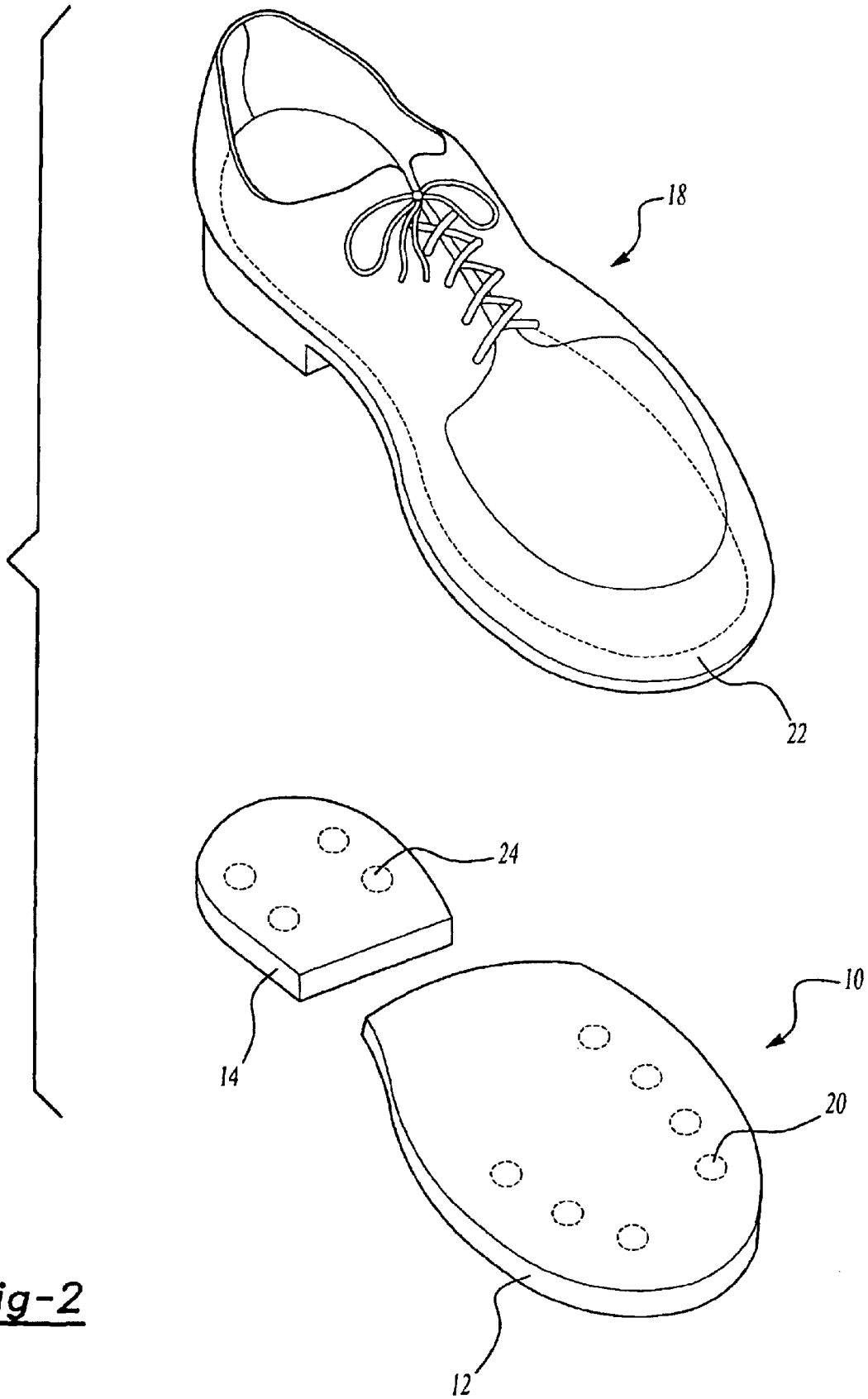
FIG. 2 shows and exploded view of the outer sole and heel plate of FIG. 1 and a typical flat-soled shoe, wherein the outer sole and heel plate are formed as separate elements.
Figure 5:
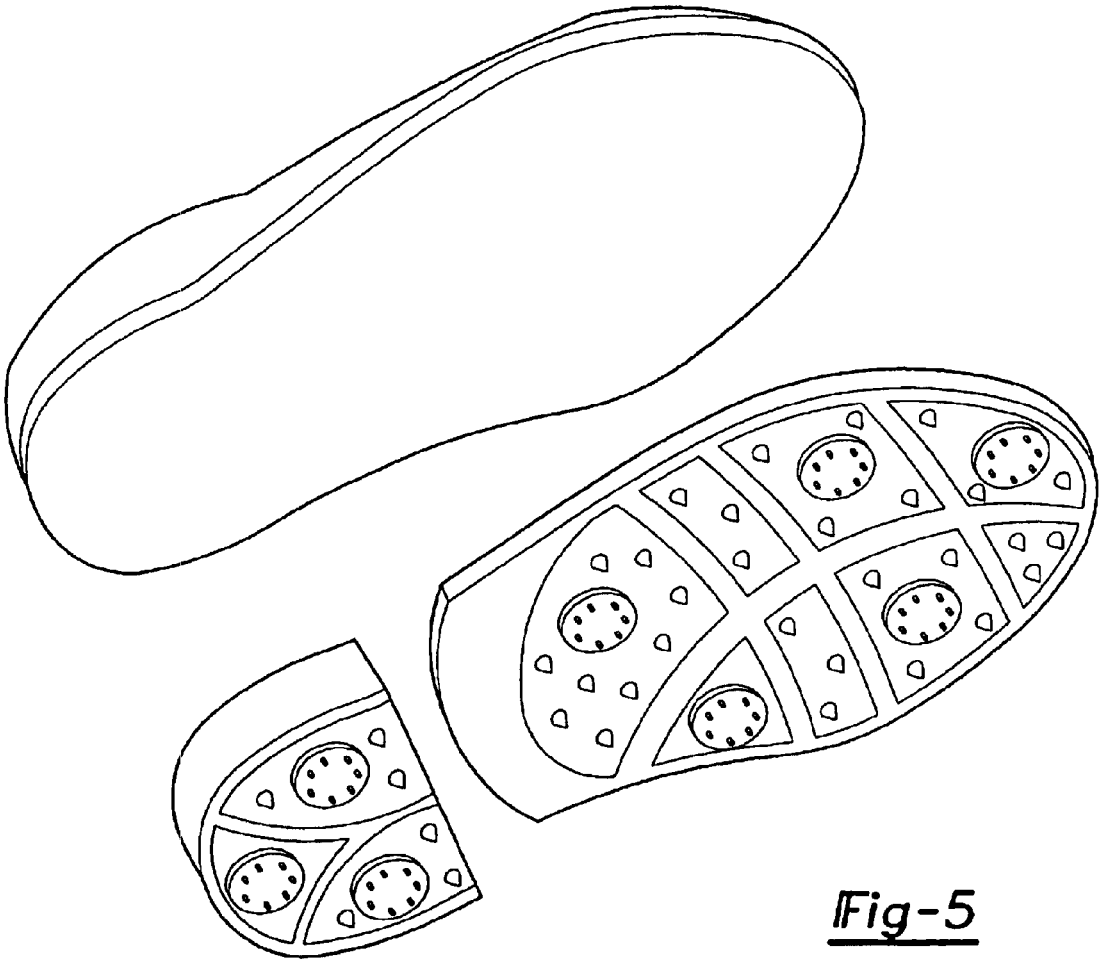
FIG. 5 shows an alternative form of the outer sole and heel plate of FIG. 3, wherein surface gripping devices are integrally formed with the outer sole and heel plate.

FIG. 1 and shows an embodiment of the replacement sole 10 formed in accordance with the teachings of this invention. In the embodiment shown, the replacement sole 10 includes an integral shoe outer sole 12 and a heel plate 14 formed in accordance with the teachings of the present invention. One of ordinary skill in the art will appreciate that the outer sole 12 and the heel plate 14 can be formed as separate elements as shown in FIGS. 2, 3 and 5. As shown in FIG. 2, the outer sole 12 and heel plate 14 can be used as a replacement sole for a dress or sports shoe 18.

Turning now to a discussion of the elements comprising the shoe outer sole 12, the outer sole 12 can be a plastic or rubber material, and can be molded or formed using known techniques such as injection molding. As best seen in FIG. 3, the outer sole 12 is designed to have a size and shape that permits coupling to the bottom surface of the shoe upper portion 22. As best seen in FIG. 1, the outer sole 12 can also include a plurality of openings 20. Preferably, the openings 20 are positioned around the forward portion of the outer sole 12 in a symmetrical pattern as shown in FIG. 1.

Generally, each opening 20 may be sized to receive one or more surface-gripping devices 16, as best seen in FIG. 2. The openings 20 can include a threaded portion such as a thread insert for receiving the threaded portion of a surface-gripping device 16, wherein the surface-gripping device 16 extends downwardly from the exterior of the outer sole 12 when received in the opening 20. The surface-gripping device 16 can include spikes or cleats of the type normally used for golfing, walking, running or other activities.

Figure 4:
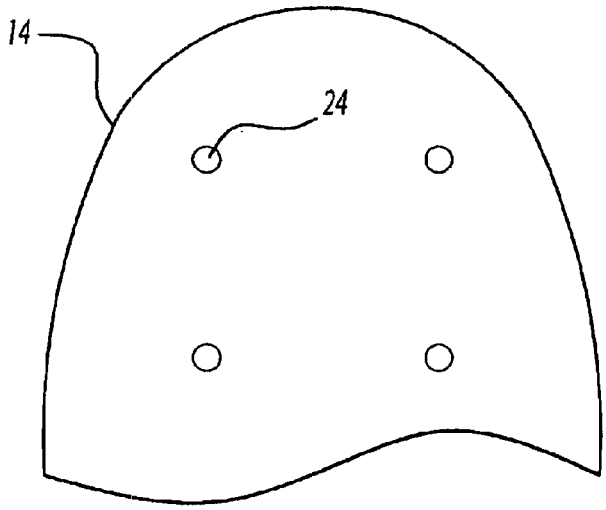
FIG. 4 shows a view of a heel plate formed as an element separate from the outer sole.

FIG. 4 shows a heel plate 14 formed in accordance with the teachings of this invention. The heel plate 14 can be a plastic or rubber material, which may be molded or formed using injection molding or other known techniques. The heel plate 14 is designed having a size and configuration for coupling to the heel portion of the bottom surface of the shoe 18 upper portion 22. The heel portion can also include a plurality of openings 24 each opening 24 being adapted to receive a surface-gripping device. In one embodiment, the openings 24 are spaced along the heel plate 14 in a symmetrical pattern.

The openings 24 can also include a threaded portion such as a threaded insert for receiving a threaded end of a surface-gripping device 16, wherein the surface-gripping device 16 extends downwardly from the exterior of the heel plate 14.

In an alternative embodiment, the shoe outer sole 12 and the surface gripping devices 16 can be formed as a unitary structure, as shown in FIG. 5. One of skill in the art will appreciate that the shoe outer sole 12 and the surface gripping devices 16 can be integrally formed during the process of molding the outer sole 12. One of skill in the art will also appreciate that the outer sole 12 and surface gripping devices 16 can be formed using a polymer such as plastic or elastomer suitable for the intended application of the shoe.

Figure 7:
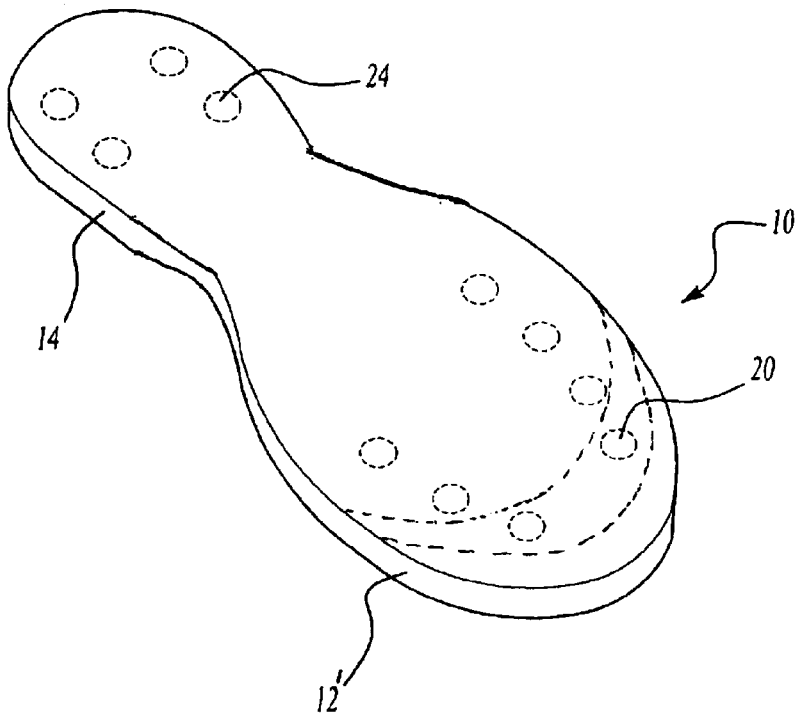
FIG. 7 shows an outer sole that may be included in the kit shown in FIG. 6.

In an alternative embodiment, the outer sole may be configured as shown in FIG. 7 by reference 12'. Although outer sole 12' is substantially similar to outer sole 12, as best seen in FIG. 7, the outer sole 12' includes trim guidelines that provide a guide for trimming the outer sole 12' as needed to a size that corresponds to the outer sole or shoe upper of the shoe to be converted. For instance, the outer sole 12' may be trimmed along the dotted lines shown in FIG. 7 or at any other convenient point thereon to adjust the size of the outer sole 12'.

ASSEMBLY

As shown in FIGS. 2 and 3, the shoe sole 12 and heel plate 14 are coupled to the bottom surface of the shoe 18 upper portion 22. For instance, the shoe sole 12 may be coupled to the shoe upper portion 22 in a manner that creates a permanent bond between the shoe upper portion 22 and the shoe sole 12. The permanent bond between the shoe upper portion 22 and the shoe sole 12 reduces significantly or completely unwanted slippage that can occur between the shoe sole 12 and the upper portion 22.

In one embodiment, the outer sole 12 and heel plate 14 are coupled to the bottom surface of the shoe 18 upper portion 22 by an adhesive, preferably a water resistant adhesive such as rubber cement, a paraffin and rubber cement combination or other similar materials. One of skill in the art will appreciate that other methods of coupling the shoe sole 12 and the heel plate 14 to the shoe upper 22 may be used. For instance, the shoe sole 12 could be sewn onto the shoe upper 22 or sewn onto the shoe upper portion and reinforced with an adhesive bond. Thus, in order to remove the shoe sole 12, the permanent bond created by the adhesive or the stitching would have to be broken using special tools or solvents or both.

One method of installation requires removing the existing sole and heel portion from the shoe 18 prior to installing outer sole 12 and heel plate 14. Using this method, the old outer sole and heel plate are removed. The bottom surface of the shoe upper portion 22 is cleaned and prepared using known techniques to receive the new outer sole 12 and heel plate 14. In preparing the shoe 18 upper portion 22 to receive the shoe sole 12 and heel plate 14, a layer of adhesive may be applied to bottom surface of the shoe upper portion 22. A second layer of adhesive may also be applied to one surface of the outer sole 12 and heel plate 14. Each of the adhesive bearing surfaces are pressed together and allowed to dry. As shown in FIGS. 2 and 3, the forward portion of the shoe 18 upper 22 supports the outer sole 12 and the reward portion of the shoe 18 upper 22 supports the heel plate 14.

One of ordinary skill in the art will appreciate that the outer sole 12 and the heel plate 14 can be coupled to the shoe 18 without removal of the existing outer sole and heel plate. In such a situation, the existing outer sole and heel plate are cleaned a prepared to receive, respectively, the new outer sole 12 and heel plate 14. It will be appreciated that the outer sole 12 and the heel plate 14 can be held in position by the use of an adhesive applied to the existing shoe outer sole and heel plate. The respective portions of the shoe 18 and the outer sole 12 and heel plate 14 are then pressed together and allowed to dry.

Where the outer sole 12 and the heel plate 14 are integrally formed, one of skill in the art will appreciate that the unitary structure can be coupled to the respective portion of the shoe 18 upper 22 (e.g., heel/sole) by an adhesive using the techniques previously described.

Additionally, where the gripping devices 16 are not integrally formed as part of the outer sole 12, the gripping devices 16 can be inserted into the openings 20 of the replacement outer sole 12 and/or the heel portion 14 before or after coupling the outer sole 12 and/or heel plate 14 to the shoe upper portion 22.

SHOE CONVERSION KIT

In another embodiment, the invention is directed to a shoe conversion kit 100 for converting a dress or sports shoe to an athletic shoe supporting a plurality of surface gripping devices. The kit 100 may include an outer sole 12' as shown in FIG. 7 for converting a dress or sport shoe to a golf shoe. The outer sole 12' is substantially identical to outer sole 12, and thus supports a plurality of surface gripping devices such as spikes or cleats. The outer sole 12' includes trim guidelines as shown in FIG. 7 that provide a guide for trimming the outer sole 12' as needed to a size that corresponds to the outer sole or shoe upper of the shoe to be converted. For instance, the outer sole 12' may be trimmed along the dotted lines shown in FIG. 7 or at any other convenient point thereon to adjust the size of the outer sole 12.

Figure 6:
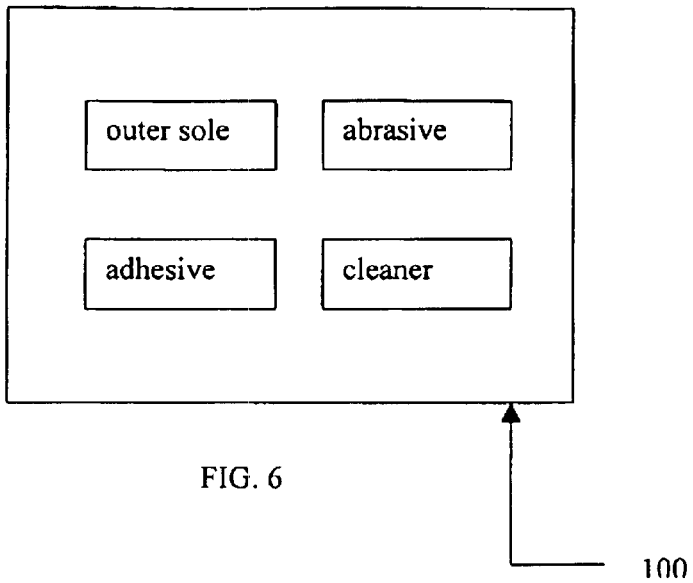
FIG. 6 shows the elements of a kit that may be used to form the shoe shown in FIGS. 2 or 5.

Referring back to FIG. 6, the kit 100 also includes an adhesive, for example a waterproof adhesive, for securing the outer sole 12' to the existing outer sole or shoe upper of the shoe to be converted. The kit 100 may also include a cleaner for preparing, e.g., cleaning, the shoe outer sole or shoe upper prior to affixing the new outer sole thereto. Additionally, the kit 100 may include an abrasive element, e.g., sandpaper, for smoothing rough or raised portions on the existing outer sole or shoe upper prior to affixing the new outer sole 12' thereto.

The present invention is also directed to a method for using the elements of the kit to convert a dress or sport shoe to an athletic shoe supporting a surface gripping device. The method includes the steps of (1) providing a kit including a replacement outer sole supporting a plurality of surface gripping devices and an adhesive for coupling the replacement outer sole to an outer sole of a shoe to be converted or to the shoe upper of a shoe to be converted; (2) adjusting, as necessary, the size of the replacement outer sole to fit the shoe to be converted; and (3) affixing the outer sole to the shoe to be converted. The method may also include the steps of cleaning the shoe upper or the existing shoe outer sole or the replacement outer sole to prepare the mating surfaces for receiving the new outer sole and smoothing any rough or raised areas on the mating surface using sand paper or other similar abrasive material.

Illustrative embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A kit for converting a dress or sport shoe into an athletic shoe supporting surface gripping devices, the kit comprising:

a replacement outer sole having a plurality of openings, each of the openings supporting a surface gripping device selected from the group consisting of spikes and cleats, the replacement outer sole further including guidelines that provide a guide for trimming the outer sole as needed to a size that corresponds to the existing outer sole or shoe upper of the shoe to be converted; and an adhesive for permanently affixing the outer sole to the existing outer sole or shoe upper of the shoe to be converted.

2. The kit defined in claim 1, wherein the adhesive is a waterproof adhesive.

3. The kit defined in claim 1, further including a cleaner for preparing existing shoe outer sole or shoe upper or the replacement outer sole prior to affixing the replacement outer sole thereto and an abrasive element for smoothing rough or raised portions on the existing outer sole or shoe upper prior to affixing the replacement outer sole thereto.

4. The kit defined in claim 1, wherein the openings of the outer sole include a threaded inset for receiving a threaded portion of a surface gripping device selected from the group including spikes and cleats.

5. A kit for converting a dress or sport shoe into an athletic shoe supporting surface gripping devices, the kit comprising:

a replacement outer sole supporting a plurality of surface gripping devices, each of the surface gripping devices being separately coupled to the replacement outer sole, the replacement outer sole further including guidelines that provide a guide for trimming the outer sole as needed to a size that corresponds to the existing outer sole or shoe upper of the shoe to be converted; and an adhesive for permanently affixing the outer sole to the existing outer sole or shoe upper of the shoe to be converted.

6. The kit as defined in claim 5, the plurality of gripping devices being selected from the group consisting of spikes and cleats.

* * * * *